US009243801B2

(12) United States Patent
Cunha et al.

(10) Patent No.: US 9,243,801 B2
(45) **Date of Patent: *Jan. 26, 2016**

(54) COMBUSTOR LINER WITH IMPROVED FILM COOLING

(75) Inventors: Frank J. Cunha, Avon, CT (US); Nurhak Erbas-Sen, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 903 days.

This patent is subject to a terminal disclaimer.

(21) Appl. No.: 13/490,797

(22) Filed: Jun. 7, 2012

(65) Prior Publication Data

US 2013/0327057 A1 Dec. 12, 2013

(51) Int. Cl.

| | |
|---|---|
| ***F02K 3/08*** | (2006.01) |
| ***F23R 3/00*** | (2006.01) |
| ***F23R 3/06*** | (2006.01) |

(52) U.S. Cl.

CPC ..... *F23R 3/002* (2013.01); *F23R 3/005* (2013.01); *F23R 3/06* (2013.01); *F23R 2900/03042* (2013.01); *F23R 2900/03043* (2013.01); *F23R 2900/03044* (2013.01); *F23R 2900/03045* (2013.01)

(58) Field of Classification Search

CPC ..... F23R 3/06; F23R 3/002; F23R 3/005; F23R 2900/03042–2900/03045

USPC ..... 60/752, 754, 757, 758, 760

See application file for complete search history.

(56) References Cited

U.S. PATENT DOCUMENTS

| | | | | |
|---|---|---|---|---|
| 2,919,549 | A * | 1/1960 | Haworth et al. | 60/753 |
| 3,919,840 | A | 11/1975 | Markowski | |
| 4,184,326 | A | 1/1980 | Pane, Jr. et al. | |
| 5,458,461 | A | 10/1995 | Lee et al. | |
| 5,461,866 | A | 10/1995 | Sullivan et al. | |
| 5,465,572 | A | 11/1995 | Nicoll et al. | |
| 5,660,525 | A | 8/1997 | Lee et al. | |
| 6,237,344 | B1 | 5/2001 | Lee | |
| 6,260,359 | B1 | 7/2001 | Monty et al. | |
| 6,826,913 | B2 | 12/2004 | Wright | |
| 6,890,154 | B2 | 5/2005 | Cunha | |
| 7,000,400 | B2 | 2/2006 | Schumacher et al. | |

(Continued)

FOREIGN PATENT DOCUMENTS

GB 2216645 10/1989

OTHER PUBLICATIONS

International Search Report and Written Opinion for PCT/US2013/043543, filed May 31, 2013, mailed Nov. 18, 2013.

(Continued)

*Primary Examiner* — Charles Freay

(74) *Attorney, Agent, or Firm* — Kinney & Lange, P.A.

(57) ABSTRACT

A heat shield for a combustor liner includes first linear film cooling slots through the heat shield and second linear film cooling slots through the heat shield. The first linear film cooling slots are run in a row and each of the first linear film cooling slots is angled from the row in a first direction. The second linear film cooling slots also run in the row and each of the second linear film cooling slots is angled from the row in a second direction opposite the first direction. The second linear film cooling slots alternate with the first linear film cooling slots in the row. The first and second linear film cooling slots are connected to form a single, multi-cornered film cooling slot.

16 Claims, 8 Drawing Sheets

(56) References Cited

U.S. PATENT DOCUMENTS

| | | | | |
|---|---|---|---|---|
| 7,093,439 | B2 | 8/2006 | Pacheco-Tougas et al. | |
| 7,146,815 | B2 * | 12/2006 | Burd | 60/752 |
| 7,246,993 | B2 | 7/2007 | Bolms et al. | |
| 7,704,039 | B1 | 4/2010 | Liang | |
| 8,028,529 | B2 | 10/2011 | Venkataraman et al. | |
| 8,122,726 | B2 | 2/2012 | Tschirren et al. | |
| 8,127,553 | B2 * | 3/2012 | Ekkad et al. | 60/752 |
| 2004/0146399 | A1 * | 7/2004 | Bolms et al. | 415/175 |
| 2005/0022531 | A1 | 2/2005 | Burd | |
| 2005/0081526 | A1 | 4/2005 | Howell et al. | |
| 2006/0005543 | A1 | 1/2006 | Burd | |
| 2006/0059916 | A1 | 3/2006 | Cheung et al. | |
| 2008/0010992 | A1 | 1/2008 | Patterson et al. | |
| 2009/0100840 | A1 | 4/2009 | Campion et al. | |
| 2009/0308077 | A1 | 12/2009 | Shelley et al. | |
| 2010/0077763 | A1 | 4/2010 | Alkabie | |
| 2010/0095678 | A1 | 4/2010 | Hawie et al. | |
| 2010/0095679 | A1 | 4/2010 | Rudrapatna et al. | |
| 2010/0095680 | A1 | 4/2010 | Rudrapatna et al. | |
| 2010/0239409 | A1 | 9/2010 | Draper | |
| 2010/0242487 | A1 | 9/2010 | Davis, Jr. et al. | |
| 2011/0005233 | A1 * | 1/2011 | Sadig et al. | 60/754 |
| 2011/0011093 | A1 | 1/2011 | Gerendas et al. | |
| 2011/0011095 | A1 | 1/2011 | Ladd et al. | |
| 2011/0048024 | A1 | 3/2011 | Snyder et al. | |
| 2011/0126543 | A1 * | 6/2011 | Kirsopp et al. | 60/742 |
| 2011/0185739 | A1 | 8/2011 | Bronson et al. | |
| 2013/0025287 | A1 * | 1/2013 | Cunha | 60/772 |
| 2014/0096528 | A1 * | 4/2014 | Cunha et al. | 60/755 |

OTHER PUBLICATIONS

Siw, S.C., Chyu, M.K., Shih, T I-P., Alvin, M.A., "Effects of Pin Detached Space on Heat Transfer and From Pin Fin Arrays," J. Heat Transfer 134, 081902 (2012).

Lee, K-D., Kim, K-Y., "Surrogate Based Optimization of a Laidback Fan-shaped Hole for Film-cooling" International Journal of Heat and Fluid Flow, vol. 32, issue 1, Feb. 2011.

Longwell, J.P., Weiss, A.M., "High Temperature Reaction Rate in Hydrocarbon Combustion," Ind and Eng. Chemistry, vol. 47, No. 8, 1955.

Cunha et al., U.S. Appl. No. 13/490,760, filed Jun. 7, 2012.

Cunha et al., U.S. Appl. No. 13/490,776, filed Jun. 7, 2012.

Cunha et al., U.S. Appl. No. 13/490,809, filed Jun. 7, 2012.

International Search Report and Written Opinion, mailed Sep. 13, 2013, for PCT/US2012/043545.

International Search Report and Written Opinion, mailed Aug. 23, 2013, for PCT/US2013/043584.

International Search Report and Written Opinion, mailed Sep. 13, 2013, for PCT/US2013/043589.

* cited by examiner

COMBUSTOR LINER WITH IMPROVED FILM COOLING

BACKGROUND

The present invention relates to a turbine engine. In particular, the invention relates to liner cooling for combustor for a gas turbine engine.

A turbine engine ignites compressed air and fuel in a combustion chamber, or combustor, to create a flow of hot combustion gases to drive multiple stages of turbine blades. The turbine blades extract energy from the flow of hot combustion gases to drive a rotor. The turbine rotor drives a fan to provide thrust and drives compressor to provide a flow of compressed air. Vanes interspersed between the multiple stages of turbine blades align the flow of hot combustion gases for an efficient attack angle on the turbine blades.

There is a desire to improve the fuel efficiency, or thrust specific fuel consumption (TSFC), of turbine engines. TSFC is a measure of the fuel consumed per unit of thrust produced by an engine. Fuel efficiency may be improved by increasing the combustion temperature and pressure under which the engine operates. However, under such conditions, undesirable combustion byproducts (e.g. nitrogen oxides (NOx)) may form at an increased rate. In addition, the higher temperatures may require additional cooling air to protect engine components. A source of cooling air is typically taken from a flow of compressed air produced upstream of the turbine stages. Energy expended on compressing air used for cooling engine components is not available to produce thrust. Improvements in the efficient use of compressed air for cooling engine components can improve the overall efficiency of the turbine engine.

SUMMARY

An embodiment of the present invention is a heat shield for a combustor liner. The heat shield includes first linear film cooling slots through the heat shield and second linear film cooling slots through the heat shield. The first linear film cooling slots are run in a row and each of the first linear film cooling slots is angled from the row in a first direction. The second linear film cooling slots also run in the row and each of the second linear film cooling slots is angled from the row in a second direction opposite the first direction. The second linear film cooling slots alternate with the first linear film cooling slots in the row. The first and second linear film cooling slots are connected to form a single, multi-cornered film cooling slot.

DETAILED DESCRIPTION

The present invention improves the efficiency of a gas turbine engine by reducing the cooling air required to cool a combustor. Combustor liners may include any or all of four features: dilution openings in a staggered, overlapping arrangement, a convergent channel within the combustor liner, a jet wall within the combustor liner, and a multi-cornered cooling film slot. Employing dilution openings in a staggered, overlapping arrangement provides full circumferential coverage around a combustor and eliminates high-heat flux areas downstream of the dilution openings, thus reducing combustor liner cooling requirements. A series of projecting walls and wall turbulators, or trip strips, form a convergent channel within the liner to increase cooling flow velocity and improve convective heat transfer. A jet wall also increases the velocity of cooling air by creating a wall shear jet across the hot surface of the liner. Finally, a multi-cornered film cooling slot forms a film cooling layer on the inside surface of the liner that spreads out to uniformly cover the surface. Together, the staggered dilution openings, convergent channel, jet wall, and multi-cornered film cooling slot significantly reduce the cooling air requirements of a combustor and improve the fuel efficiency of a gas turbine engine.

Figure 1:
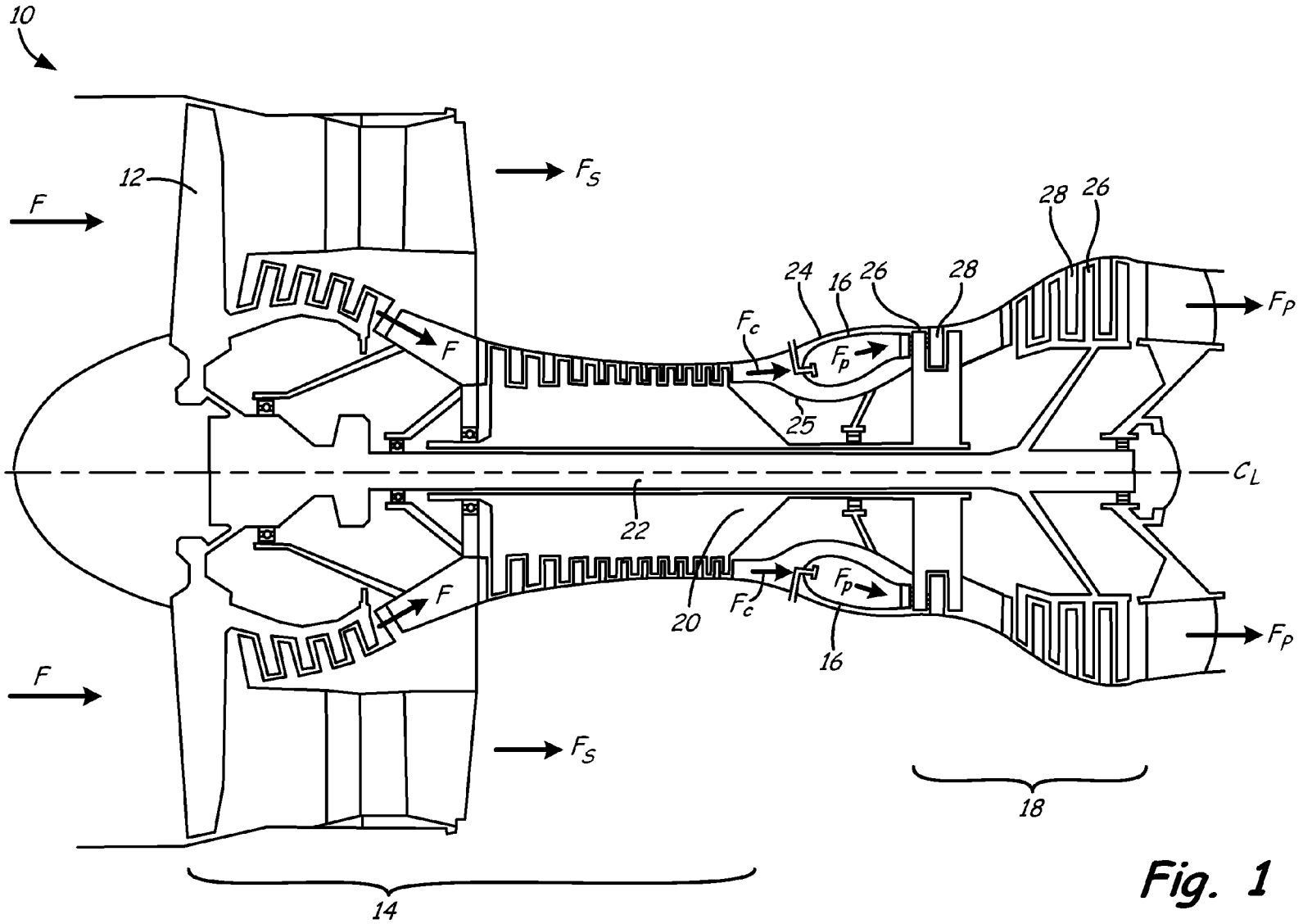
FIG. 1 is a sectional view of a gas turbine engine embodying the present invention.

FIG. 1 is a representative illustration of a gas turbine engine including a combustor embodying the present invention. The view in FIG. 1 is a longitudinal sectional view along an engine center line. FIG. 1 shows gas turbine engine 10 including fan 12, compressor 14, combustor 16, turbine 18, high-pressure rotor 20, low-pressure rotor 22, outer casing 24, and inner casing 25. Turbine 18 includes rotor stages 26 and stator stages 28.

As illustrated in FIG. 1, fan 12 is positioned along engine center line $C_L$ at one end of gas turbine engine 10. Compressor 14 is adjacent fan 12 along engine center line $C_L$, followed by combustor 16. Combustor 16 is an annular structure that extends circumferentially around engine center line $C_L$. Turbine 18 is located adjacent combustor 16, opposite compressor 14. High-pressure rotor 20 and low-pressure rotor 22 are mounted for rotation about engine center line $C_L$. High-pressure rotor 20 connects a high-pressure section of turbine 18 to compressor 14. Low-pressure rotor 22 connects a low-pressure section of turbine 18 to fan 12. Rotor blades 26 and stator vanes 28 are arranged throughout turbine 18 in alternating rows. Rotor blades 26 connect to high-pressure rotor 20 and low-pressure rotor 22. Outer casing 24 surrounds turbine engine 10 providing structural support for compressor 14, and turbine 18, as well as containment for a flow of cooling air Fc. Inner casing 25 is generally radially inward from combustor 16 providing structural support for combustor 16 as well as containment for the flow of cooling air Fc.

In operation, air flow F enters compressor 14 through fan 12. Air flow F is compressed by the rotation of compressor 14 driven by high-pressure rotor 20 producing a flow of cooling air Fc. Cooling air Fc flows between combustor 16 and each of outer case 24 and inner case 25. A portion of cooling air Fc enters combustor 16, with the remaining portion of cooling air Fc employed farther downstream for cooling other components exposed to high-temperature combustion gases, such as rotor blades 26 and stator vanes 28. Compressed air and fuel are mixed and ignited in combustor 16 to produce high-temperature, high-pressure combustion gases Fp. Combustion gases Fp exit combustor 16 into turbine section 18. Stator vanes 28 properly align the flow of combustion gases Fp for an efficient attack angle on subsequent rotor blades 26. The flow of combustion gases Fp past rotor blades 26 drives rotation of both high-pressure rotor 20 and low-pressure rotor 22. High-pressure rotor 20 drives a high-pressure portion of compressor 14, as noted above, and low-pressure rotor 22 drives fan 12 to produce thrust Fs from gas turbine engine 10. Although embodiments of the present invention are illustrated for a turbofan gas turbine engine for aviation use, it is understood that the present invention applies to other aviation gas turbine engines and to industrial gas turbine engines as well.

Figure 2:
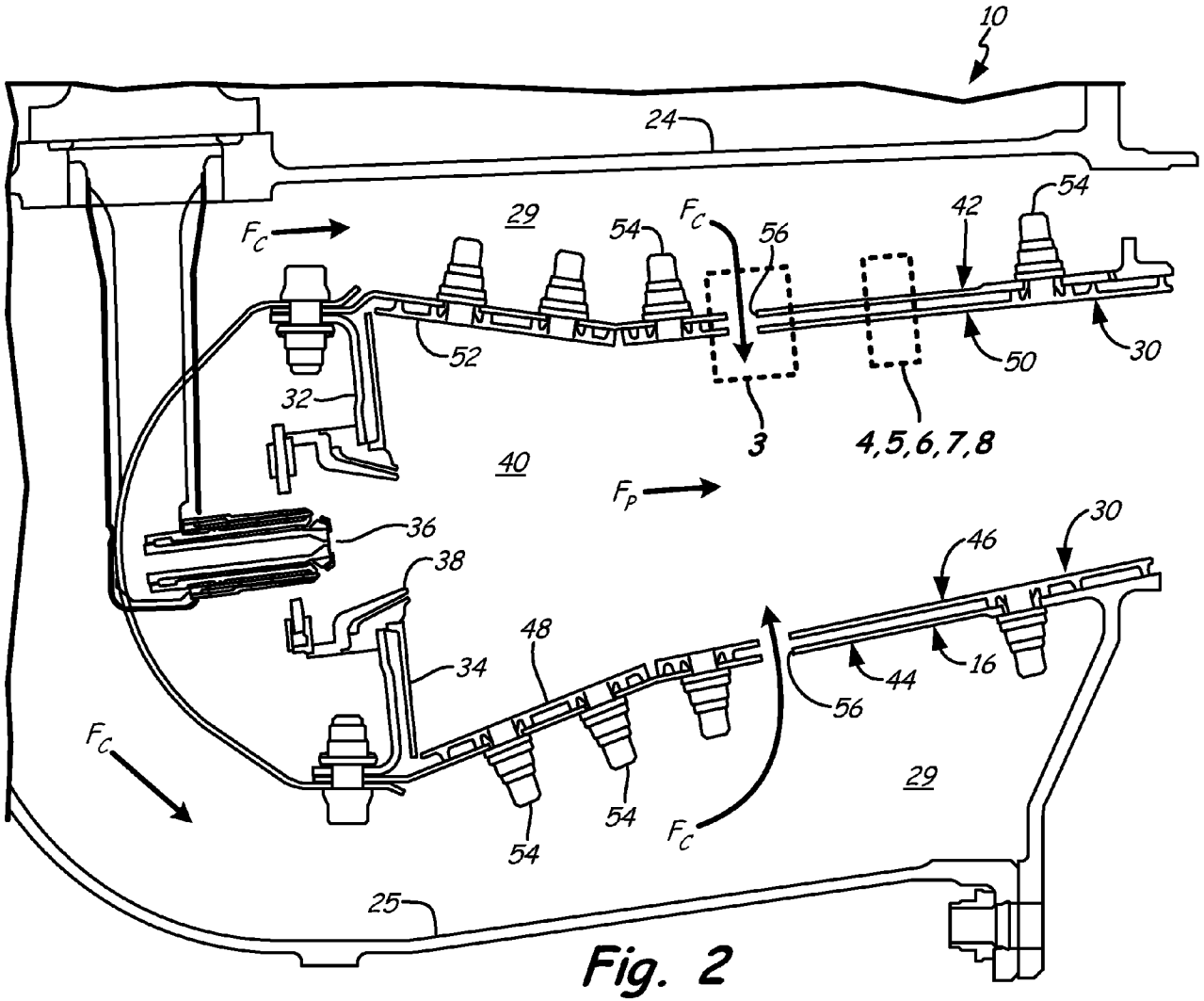
FIG. 2 is an enlarged sectional view of the combustor of the gas turbine engine shown in FIG. 1.

FIG. 2 is an enlarged view illustrating details of combustor 16 of gas turbine engine 10 shown in FIG. 1. FIG. 2 illustrates combustor 16, outer case 24, and inner case 25. Outer case 24 and inner case 25 are radially outward and inward, respectively, from combustor 16, thus creating annular plenum 29 around combustor 16. Combustor 16 is an annular structure that extends circumferentially around engine center line $C_L$. Combustor 16 includes combustor liner 30, bulkhead 32, bulkhead heat shield 34, fuel nozzle 36, swirler 38, and combustion chamber 40. Combustor liner 30 includes outer shell 42, inner shell, 44, aft inside diameter (ID) heat shield 46, forward ID heat shield 48, aft outside diameter (OD) heat shield 50, forward OD heat shield 52, studs 54, and dilution openings 56. Combustor 16 is an annular structure that extends circumferentially around engine center line $C_L$, thus combustor liner 30 is arcuate in shape, with an axis coincident with engine center line $C_L$.

Combustion chamber 40 within combustor 16 is bordered radially by combustor liner 30, by bulkhead 32 on the upstream axial end, with a combustion gas opening on the downstream axial end. Swirler 38 connects fuel nozzle 36 to bulkhead 32 through an opening in bulkhead 32. Bulkhead 32 is protected from the hot flow of combustion gases Fp generated within combustion chamber 40 by bulkhead heat shield 34. Aft ID heat shield 46 and forward ID heat shield 48 are attached to inner shell 44 to make up the inside diameter portion of combustor liner 30. Similarly, aft OD heat shield 50 and forward OD heat shield 52 are attached to outer shell 42 to make up the outside diameter portion of combustor liner 30. Heat shields 46, 48, 50, 52 are attached to their respective shell 42, 44 by studs 52 projecting from heat shields 46, 48, 50, 52. Dilution openings 56 are openings through combustor liner 30 permitting the flow of cooling air flow from plenum 29 into combustion chamber 40.

In operation, fuel from fuel nozzle 36 mixes with air in swirler 38 and is ignited in combustion chamber 40 to produce the flow of combustion gases Fp for use by turbine 18 as described above in reference to FIG. 1. As the flow of combustion gases Fp passes through combustion chamber 40, a flow of cooling air Fc is injected into combustion chamber 40 from plenum 29 through dilution openings 56 to create dilution jets into the flow of combustion gases Fp. The dilution jets serve to mix and cool the flow of combustion gases Fp to reduce the formation of NOx. The dilution jets in this embodiment reduce combustor cooling requirements, as described below in reference to FIG. 3. Combustor liner 30 is cooled by a flow of cooling air Fc flowing from plenum 29 through combustor liner 30, as will be described in greater detail below in reference to FIGS. 4A, 4B, 5A, 5B, 6A, 6B, 7A, 7B, 8A, and 8B.

Figure 3:
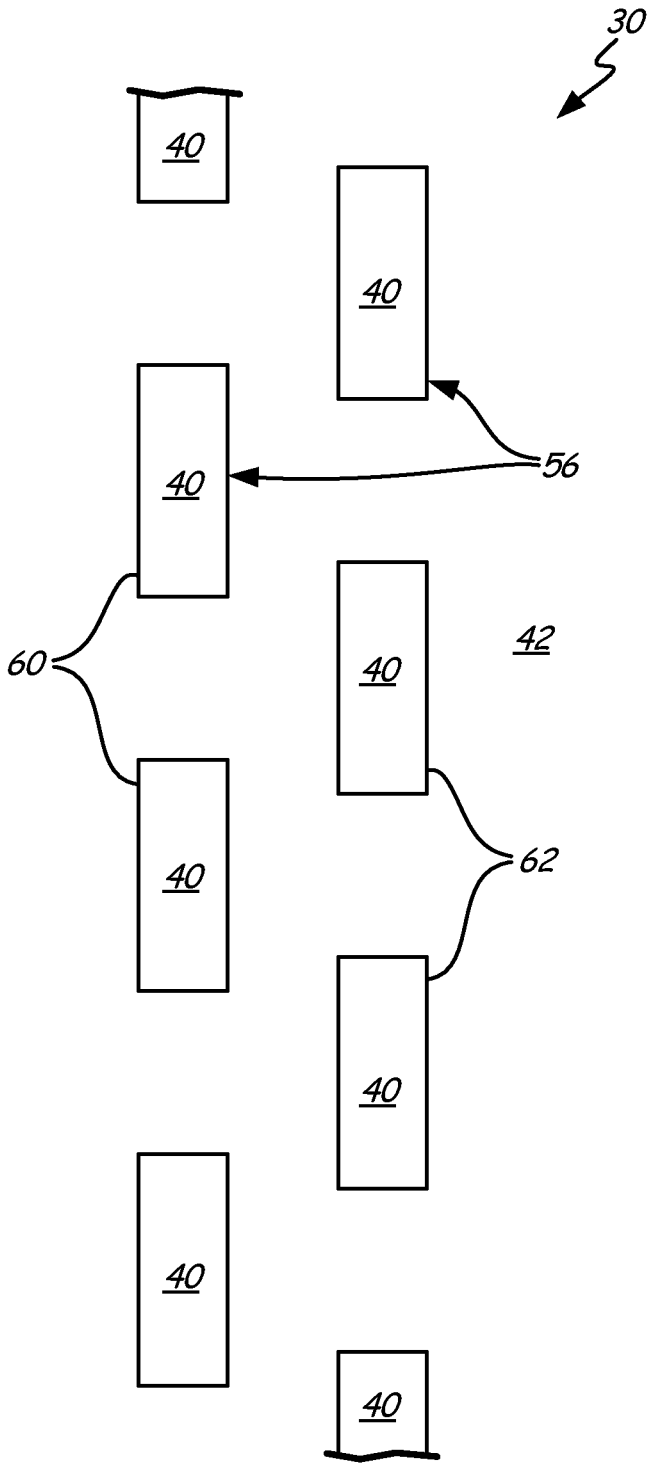
FIG. 3 is a top view of a portion of the combustor shown in FIG. 2.

FIG. 3 is a top view of a portion of the combustor shown in FIG. 2. Specifically, FIG. 3 shows dilution openings 56 in outer shell 42 of combustor liner 30 where outer shell 42 is protected by aft OD heat shield 50, as shown in FIG. 2. In this view, only dilution openings 56 in outer shell 42 are shown, but it is understood that because dilution openings 56 penetrate combustor liner 30 between plenum 39 and combustion chamber 30, aft outer heat shield 50 also includes dilution openings 56. As shown in FIG. 3, dilution openings 56 open into combustion chamber 40 and include first row of dilution openings 60 and second row of dilution openings 62. Both first row of dilution openings 60 and second row of dilution openings 62 run in the circumferential direction and are parallel to each other. Second row of dilution openings 62 is axially spaced from first row of dilution openings 60 only as far as required to maintain the structural integrity of combustor liner 30. Each dilution opening 62 is disposed in a staggered relationship with two adjacent dilution openings 60 such that each dilution opening 62 at least partially overlaps two adjacent dilution openings 60 in an axial direction. Dilution openings 56 may be substantially rectangular in shape, as illustrated in FIG. 3, or may be of other shapes, so long as they overlap in the axial direction.

In operation, dilution openings 56 direct the flow of cooling air Fc to produce dilution jets within combustion chamber 40 in a staggered, overlapping arrangement that provides full circumferential coverage around the circumference of combustor 16. This coverage eliminates recirculation zones that would otherwise form downstream of the dilution jets, thus eliminating high-heat flux areas that would form in the recirculation zone downstream of the dilution jets. Because the high-heat flux areas are eliminated, there is less need to cool combustor liner 30. In addition, because dilution openings 56 provide full circumferential coverage, mixing of the flow of cooling air Fc into the flow of combustion gases Fp is improved, decreasing temperatures within the flow of combustion gases Fp faster, resulting in decreased NOx formation.

Figure 4A:
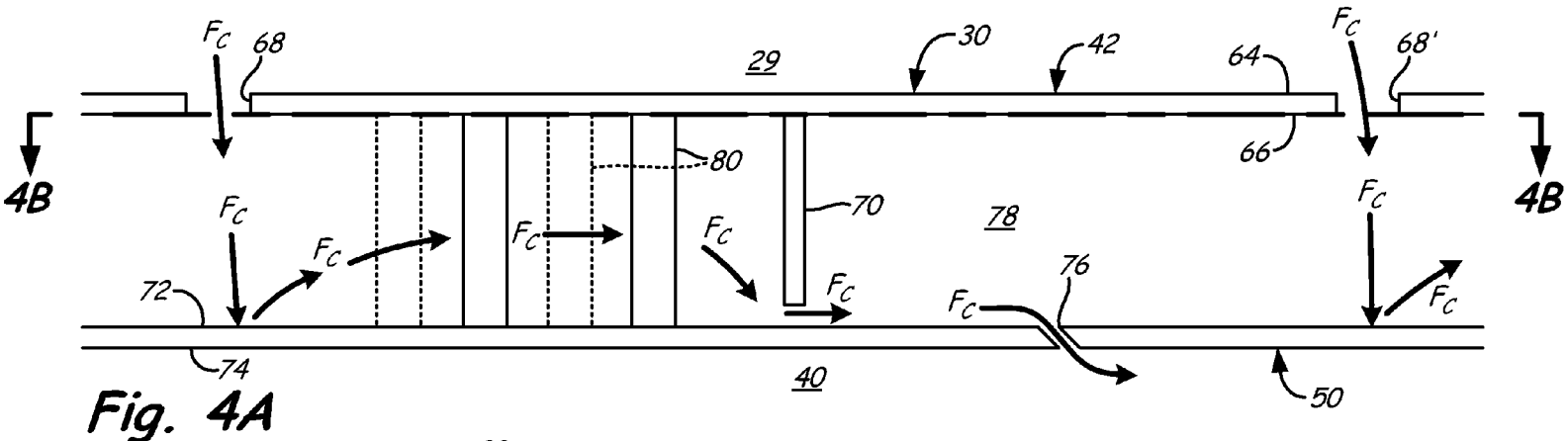
FIGS. 4A and 4B are further enlarged side and top sectional views, respectively, of a combustor liner of the combustor of FIG. 2.
Figure 4B:
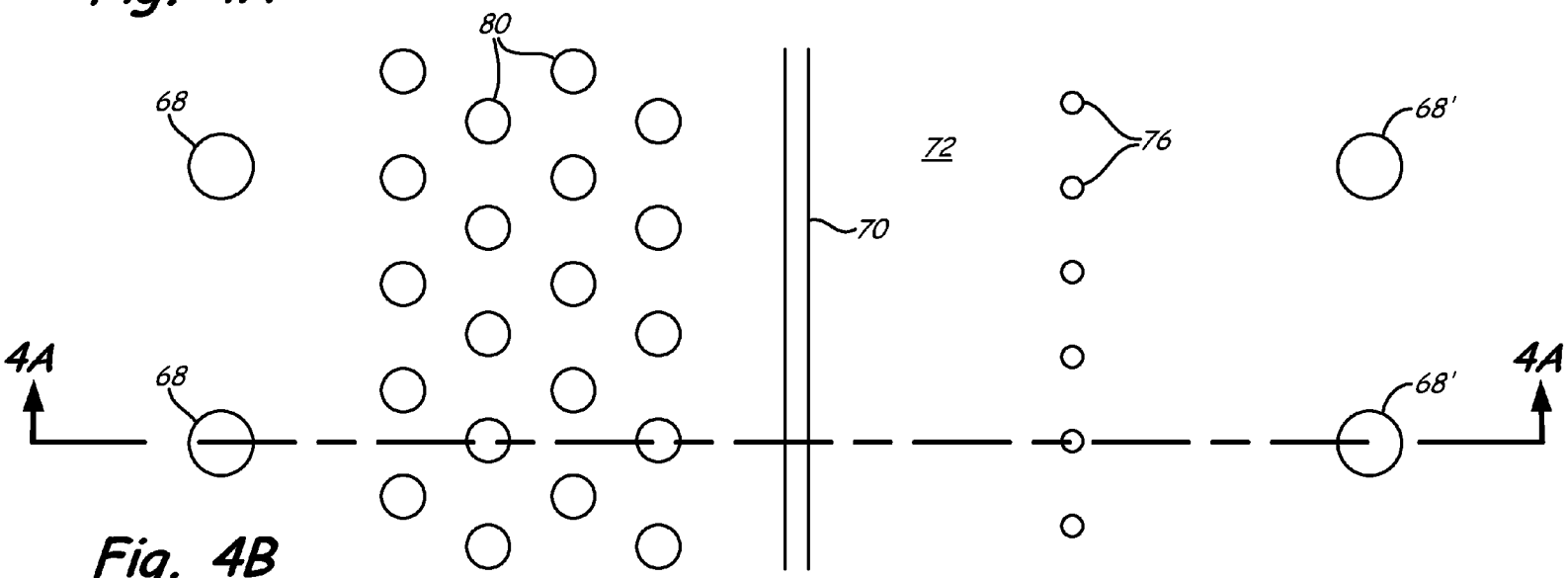

Another feature for improving the efficiency of a gas turbine engine by reducing the cooling air required to cool a combustor is shown in FIGS. 4A and 4B. FIGS. 4A and 4B are further enlarged side and top sectional views, respectively, of combustor liner 30 of combustor 16 of FIG. 2. FIG. 4A shows combustor liner 30 separating plenum 29 and combustion chamber 40. Combustor liner 30 includes outer shell 42 and aft OD heat shield 50. Outer shell 42 includes shell cold side 64, shell hot side 66, row of impingement cooling holes 68, and jet wall 70. Aft OD heat shield 50 includes shield cold side 72, shield hot side 74, and row of film cooling holes 76. Together, outer shell 42 and aft OD heat shield 50 define cooling air passageway 78 between shell hot side 66 and shield cold side 72. This embodiment also optionally includes pedestal array 80.

Considering FIGS. 4A and 4B together, shell cold side 64 faces plenum 29 while shell hot side faces away from plenum 29, toward shield cold side 72 and combustion chamber 40. Shield hot side 74 faces combustion chamber 40 while shield cold side 72 faces away from combustion chamber 40, toward shell hot side 66 and plenum 29. Row of impingement cooling holes 68 runs in a circumferential direction and allows the flow of cooling air Fc to flow from shell cold side 64 to shell hot side 66. Jet wall 70 runs in a circumferential direction, transverse to the flow of cooling air Fc within cooling air passageway 78. Jet wall 70 projects from shell hot side 66 nearly to shield cold side 72 such that there is a gap between jet wall 70 and aft OD heat shield 50. Row of film cooling holes 76 runs in a circumferential direction and allows the flow of cooling air Fc to flow from shield cold side 72 to shield hot side 74. Row of film cooling holes 76 are slanted in a downstream direction to aid in the formation of a cooling film along shield hot side 74. Pedestals of pedestal array 80 extend across cooling air passage way 78 in a radial direction between shell hot side 66 and shield cold side 72.

In operation, the flow of cooling air Fc flows into cooling air passageway 78 through row of impingement holes 68. The flow of cooling air Fc impinges upon shield cold side 72, absorbing heat and cooling aft OD heat shield 50. The flow of cooling air Fc then optionally flows through pedestal array 80 where the pedestals increase the turbulence and convective heat transfer of the flow of cooling air Fc, enhancing further heat transfer from aft OD heat shield 50. The flow of cooling air Fc then flows through the gap between jet wall 70 and shield cold side 72. The large reduction in the area available for the flow of cooling air Fc presented by jet wall 70 results in a large increase in the velocity of the flow of cooling air Fc issuing from jet wall 70 and along shield cold side 72 in the tangential or shear direction The resulting "jet" of cooling air, also known as a wall shear jet, greatly increases the convective heat transfer between the flow of cooling air Fc and aft OD heat shield 50. As the flow of cooling air Fc flows along shield cold side 72 and picks up heat from aft OD heat shield 50, the velocity decreases. Once the velocity decreases such that heat transfer heat from aft OD heat shield 50 is nearly insufficient, the flow of cooling air Fc flows through row of film cooling holes 76 and on to shield hot side 74 to produce a protective cooling film on shield hot side 74.

By employing jet wall 70 to form a wall shear jet to increase the velocity of the flow of cooling air Fc across aft OD heat shield 50, efficient use is made of the flow of cooling air Fc, thus reducing the cooling air required to cool combustor 16. In addition, pattern of efficient use, including impingement cooling and film cooling, may be repeated along combustor liner 30, as indicated by another row of impingement holes 68' downstream from film cooling holes 76, which is followed by another pedestal array, jet wall, and row of film cooling holes (not shown). Row of impingement holes 68' is spaced sufficiently far downstream from jet wall 70 that velocity effects from jet wall 70 will have dissipated such that the wall shear jet does not interfere with the impingement cooling from row of impingement holes 68'.

Figure 5A:
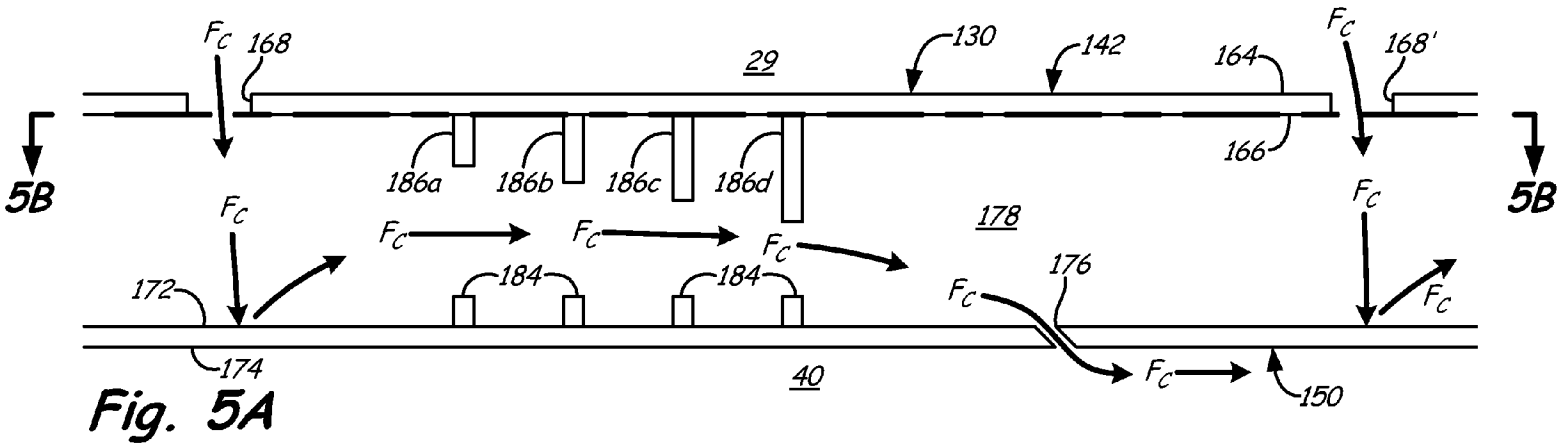
FIGS. 5A and 5B are further enlarged side and top sectional views, respectively, of another embodiment of a combustor liner of the combustor of FIG. 2.
Figure 5B:
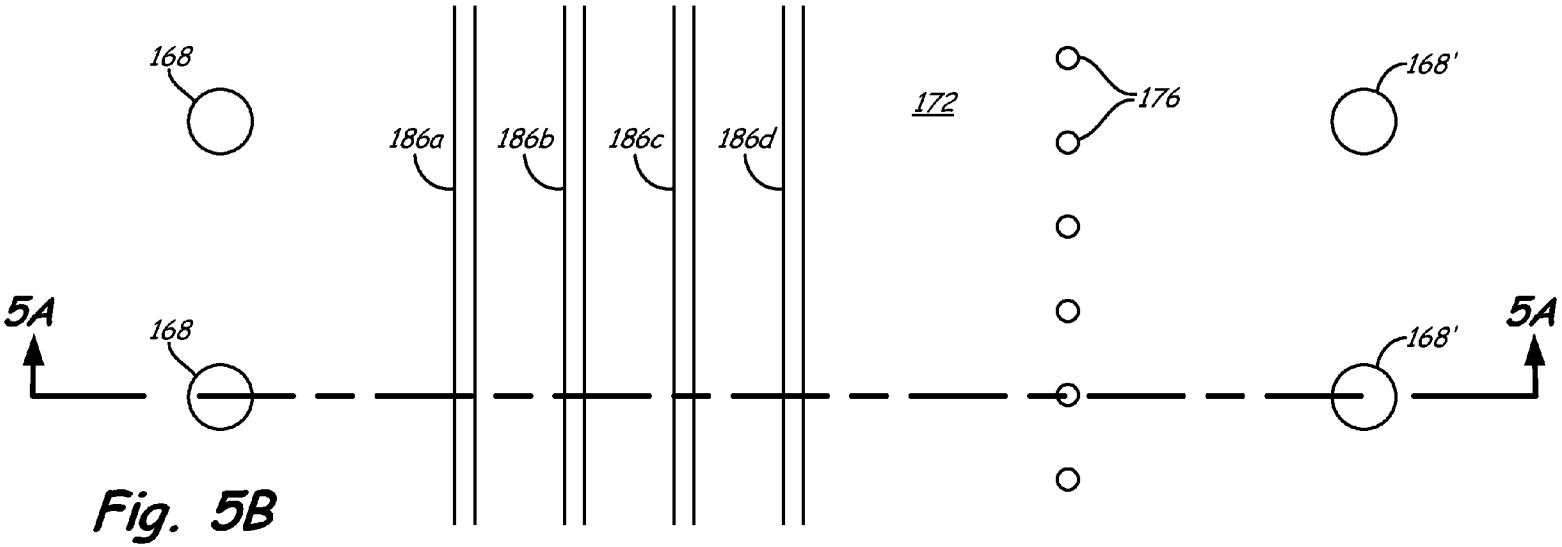

Another feature for improving the efficiency of a gas turbine engine by reducing the cooling air required to cool a combustor is shown in FIGS. 5A and 5B. FIGS. 5A and 5B are further enlarged side and top sectional views, respectively, of another embodiment of a combustor liner of the combustor of FIG. 2. FIG. 5A shows combustor liner 130 separating plenum 29 and combustion chamber 40. Combustor liner 130 is identical to combustor liner 30 described above, with numbering of like elements increased by 100, except that combustor liner 130 includes convergent channel 182 instead of jet wall 70 or pedestal array 80. As shown in FIGS. 5A and 5B, convergent channel 182 includes a plurality of trip strips 184 and a plurality of projecting walls 186*a*, 186*b*, 186*c*, and 186*d*. Trip strips 184 project from shield cold side 172 just far enough to create turbulent flow along shield cold side 172. Trip strips 184 run in a circumferential direction, transverse to the flow of cooling air Fc within cooling air passageway 178. Each projecting wall 186*a*, 186*b*, 186*c*, and 186*d* corresponds to one of plurality of trip strips 184, and runs parallel to, and opposite of, the corresponding one of plurality of trip strips 184. Projecting walls 186*a*, 186*b*, 186*c*, and 186*d* run in a series so that each projecting wall 186*a*, 186*b*, 186*c*, and 186*d* projects from shell hot side 166 such that the distance to which each projecting wall 186*a*, 186*b*, 186*c*, and 186*d* projects from shell hot side 166 is greater for those projecting walls 186*a*, 186*b*, 186*c*, and 186*d* that are farther from row of impingement cooling holes 168. Thus, projecting wall 186*d* projects the farthest from shell hot side 166, projecting wall 186*c* the second farthest, projecting wall 186*b* the third farthest, and projecting wall 186*a* projects the least distance from shell hot side 166. In this way, the successive gaps between each projecting wall 186*a*, 186*b*, 186*c*, and 186*d* and its corresponding trip strip 184 decrease from row of impingement holes 168, or in the downstream direction.

In operation, the flow of cooling air Fc flows into cooling air passageway 178 through row of impingement holes 168. The flow of cooling air Fc impinges upon shield cold side 172, absorbing heat and cooling aft OD heat shield 150. The flow of cooling air Fc then flows through convergent channel 182. The decreasing gaps of convergent channel 182 in the downstream direction cause an increase in the velocity of the flow of cooling air Fc. In combination with the turbulent flow created by plurality of trip strips 184, the increase in velocity increases the convective heat transfer from aft OD heat shield 150 to the flow of cooling air Fc. As the flow of cooling air Fc exits convergent channel 182 and flows along shield cold side 172, it picks up heat from aft OD heat shield 150 and the velocity decreases. Once the velocity decreases such that heat transfer heat from aft OD heat shield 150 is nearly insufficient, the flow of cooling air Fc flows through row of film cooling holes 176 and on to shield hot side 174 to produce a protective cooling film on shield hot side 174.

By employing convergent channel 182 to increase the velocity of the flow of cooling air Fc across aft OD heat shield 150, efficient use is made of the flow of cooling air Fc, thus reducing the cooling air required to cool combustor 16. In addition, pattern of efficient use, including impingement cooling and film cooling, may be repeated along combustor liner 130, as indicated by another row of impingement holes 168' downstream from film cooling holes 176, which is followed by another convergent channel and row of film cooling holes (not shown).

Figure 6A:
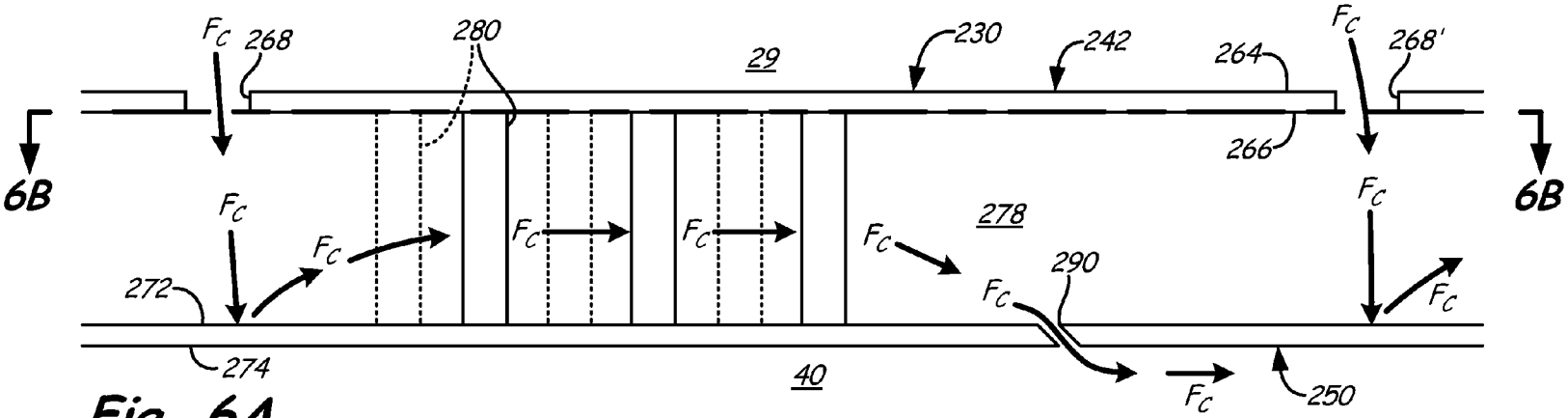
FIGS. 6A and 6B are further enlarged side and top sectional views, respectively, of another embodiment of a combustor liner of the combustor of FIG. 2.
Figure 6B:
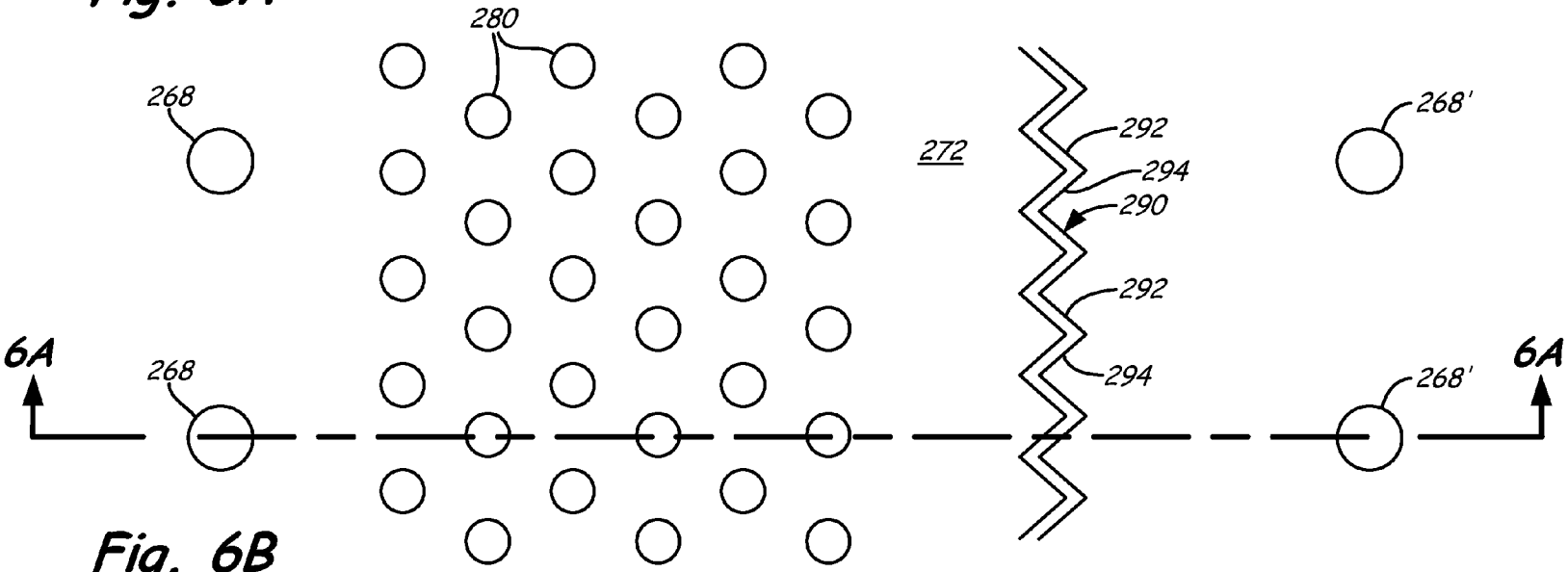

Another feature for improving the efficiency of a gas turbine engine by reducing the cooling air required to cool a combustor is shown in FIGS. 6A and 6B. FIGS. 6A and 6B are further enlarged side and top sectional views, respectively, of another embodiment of a combustor liner of the combustor of FIG. 2. FIG. 6A shows combustor liner 230 separating plenum 29 and combustion chamber 40. Combustor liner 230 is identical to combustor liner 30 described above, with numbering of like elements increased by 200, except that combustor liner 230 includes multi-cornered film cooling slot 290 instead of row of film cooling holes 76, optional pedestal array 280 is illustrated as more extensive than pedestal array 80, and combustor liner 230 does not include jet wall 70. As shown in FIGS. 6A and 6B, multi-cornered film cooling slot 290 includes a plurality of first linear film cooling slots 292 and a plurality of second linear film cooling slots 294. Plurality of first linear film cooling slots 292 runs in a row. As illustrated, the row is in a circumferential direction. Each first linear film cooling slot 292 is angled from the row in a direction. As illustrated, first linear film cooling slots 292 are angled about 45 degrees from the row. Plurality of second linear film cooling slots 294 also run in the same row as first plurality of linear film cooling slots 292. Each second linear film cooling slot 294 is angled from the row in a direction opposite that of each first linear film cooling slot 292. As illustrated, second linear film cooling slots 294 are angled about minus 45 degrees from the row. Each of plurality of second linear film cooling slots 294 alternates with each of plurality of first linear film cooling slots 292 in the row. Alternating first linear film cooling slots 292 and second linear film cooling slots 294 are connected to form a single cooling slot, multi-point film cooling slot 290.

In operation, the flow of cooling air Fc flows into cooling air passageway 278 through row of impingement holes 268. The flow of cooling air Fc impinges upon shield cold side 272, absorbing heat and cooling aft OD heat shield 250. The flow of cooling air Fc then flows through pedestal array 280 where the pedestals increase the turbulence and convective heat transfer of the flow of cooling air Fc, enhancing further heat transfer from aft OD heat shield 250. Then flow of cooling air Fc flows through multi-cornered film cooling slot 290 on to shield hot side 274 to produce a protective cooling film on shield hot side 274. In contrast to the protective cooling film produced by row of film cooling holes 56, the protective cooling film produced by multi-cornered film cooling slot 290 spreads out more uniformly over shield hot side 274 and does not decay as quickly.

By employing multi-cornered film cooling slot 290, the protective film of the flow of cooling air Fc flowing across shield hot side 274 of aft OD heat shield 250 is more even and does not decay as quickly. Thus, multi-cornered film cooling slots 290 may be spaced farther apart, making more efficient use of the flow of cooling air Fc, thus reducing the cooling air required to cool combustor 16. As with the previous embodiments, the pattern of efficient use may be repeated along combustor liner 230.

Figure 7A:
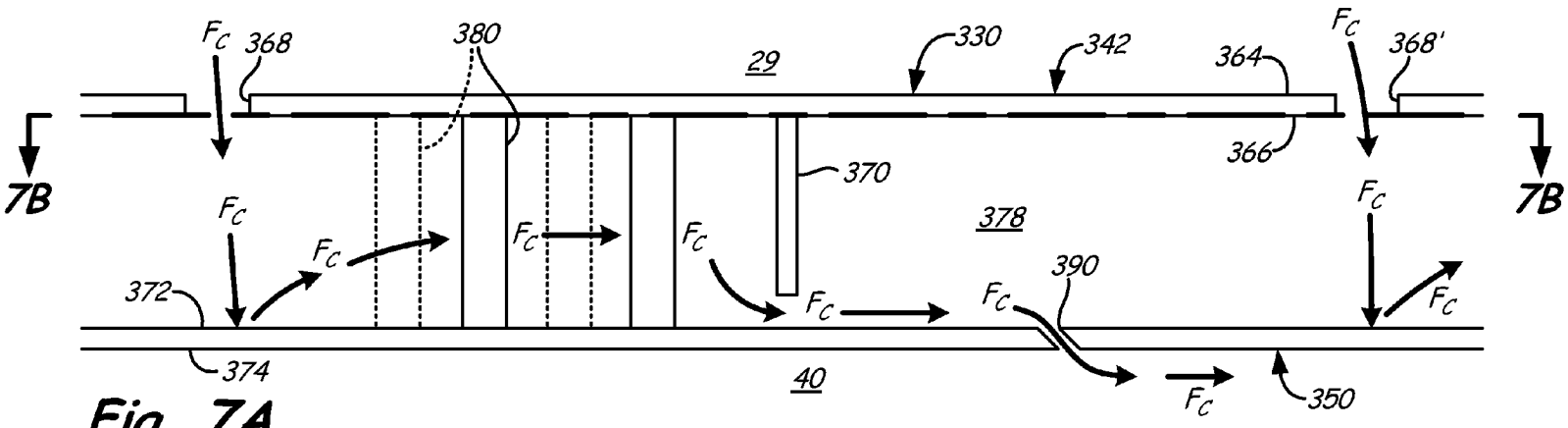
FIGS. 7A and 7B are further enlarged side and top sectional views, respectively, of another embodiment of a combustor liner of the combustor of FIG. 2.
Figure 7B:
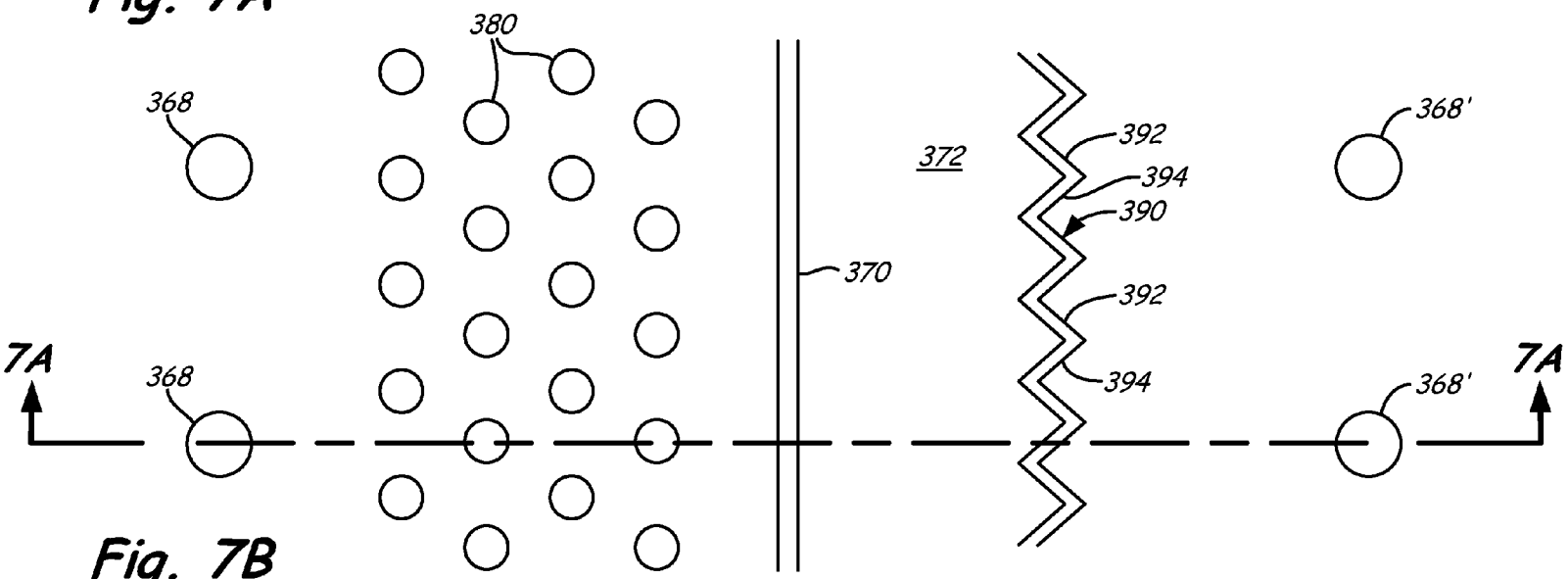

Each of the four features describe above, overlapping dilution openings 56 jet wall 70, convergent channel 182, and multi-cornered film cooling slot 290, improve the efficiency of a gas turbine engine by reducing the cooling air required to cool a combustor. However, even greater efficiency is achieved by combining two or more of the four features. Thus, it is understood that the present invention encompasses embodiments that combine any of these four features. One example illustrating the combination of features is shown in FIGS. 7A and 7B. FIGS. 7A and 7B are further enlarged side and top sectional views, respectively, of another embodiment of a combustor liner of the combustor of FIG. 2. The embodiment illustrated in FIGS. 7A and 7B combines jet wall 70 and multi-cornered film cooling slot 290. Though not shown in FIGS. 7A and 7B, this embodiment also includes dilution openings 56 as described above in reference to FIG. 3. Thus, three of the four features described above are included in this embodiment.

Combustor liner 330 is identical to combustor liner 30 described above in reference to FIGS. 4A and 4B, with numbering of like elements increased by 300, except that combustor liner 330 includes multi-cornered film cooling slot 390 instead of row of film cooling holes 76. Multi-cornered film cooling slot 390 is identical to multi-cornered film cooling slot 290 described above in reference to FIGS. 6A and 6B, with numbering of like elements increased by 100.

In operation, the flow of cooling air Fc flows into cooling air passageway 378 through row of impingement holes 368. The flow of cooling air Fc impinges upon shield cold side 372, absorbing heat and cooling aft OD heat shield 350. The flow of cooling air Fc then flows through pedestal array 380 where the pedestals increase the turbulence and convective heat transfer of the flow of cooling air Fc, enhancing further heat transfer from aft OD heat shield 350. The flow of cooling air Fc then flows through the gap between jet wall 370 and shield cold side 372. The large reduction in the area available for the flow of cooling air Fc presented by jet wall 370 results in a large increase in the velocity of the flow of cooling air Fc issuing from jet wall 370 and along shield cold side 372 in the tangential or shear direction The resulting wall shear jet greatly increases the convective heat transfer between the flow of cooling air Fc and aft OD heat shield 350. As the flow of cooling air Fc flows along shield cold side 372 and picks up heat from aft OD heat shield 350, the velocity decreases. Once the velocity decreases such that heat transfer heat from aft OD heat shield 350 is nearly insufficient, the flow of cooling air Fc flows through multi-cornered film cooling slot 390 on to shield hot side 374 to produce a protective cooling film on shield hot side 374.

Employing both jet wall 370 and multi-cornered film cooling slot 390, combustor liner 330 obtains the benefits of both features resulting in a greater reduction in the cooling air required to cool combustor 16. As with the previous embodiments, the pattern of efficient use may be repeated along combustor liner 330. Adding dilution openings 56 as described above in reference to FIG. 3 to combustor liner 330 to produce dilution jets within combustion chamber 40 in a staggered, overlapping arrangement results in an even greater reduction in cooling air requirements.

Figure 8A:
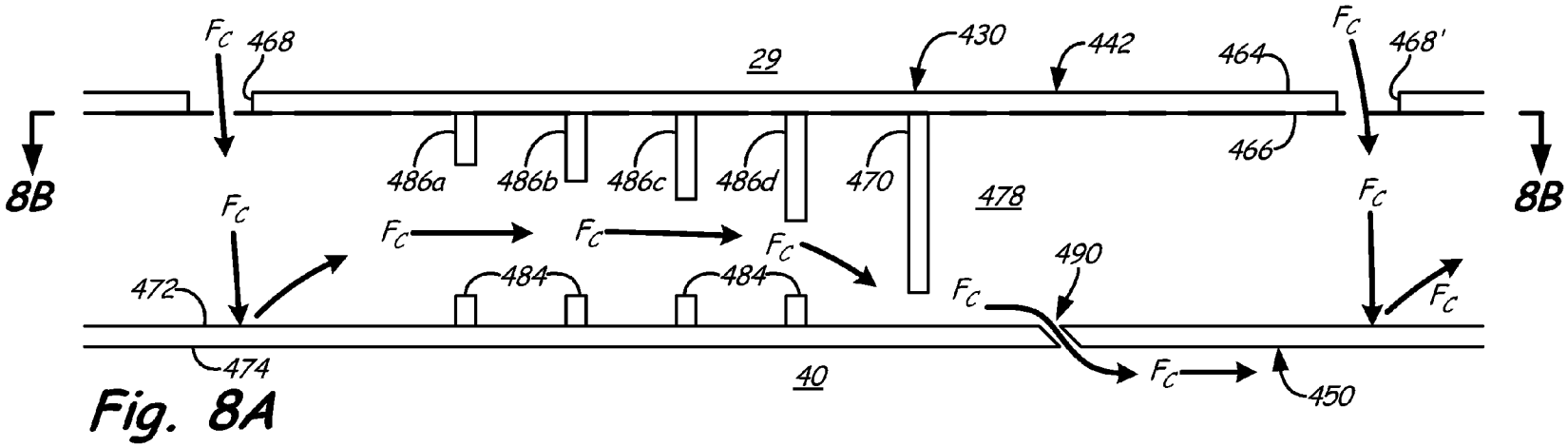
FIGS. 8A and 8B are further enlarged side and top sectional views, respectively, of another embodiment of a combustor liner of the combustor of FIG. 2.
Figure 8B:
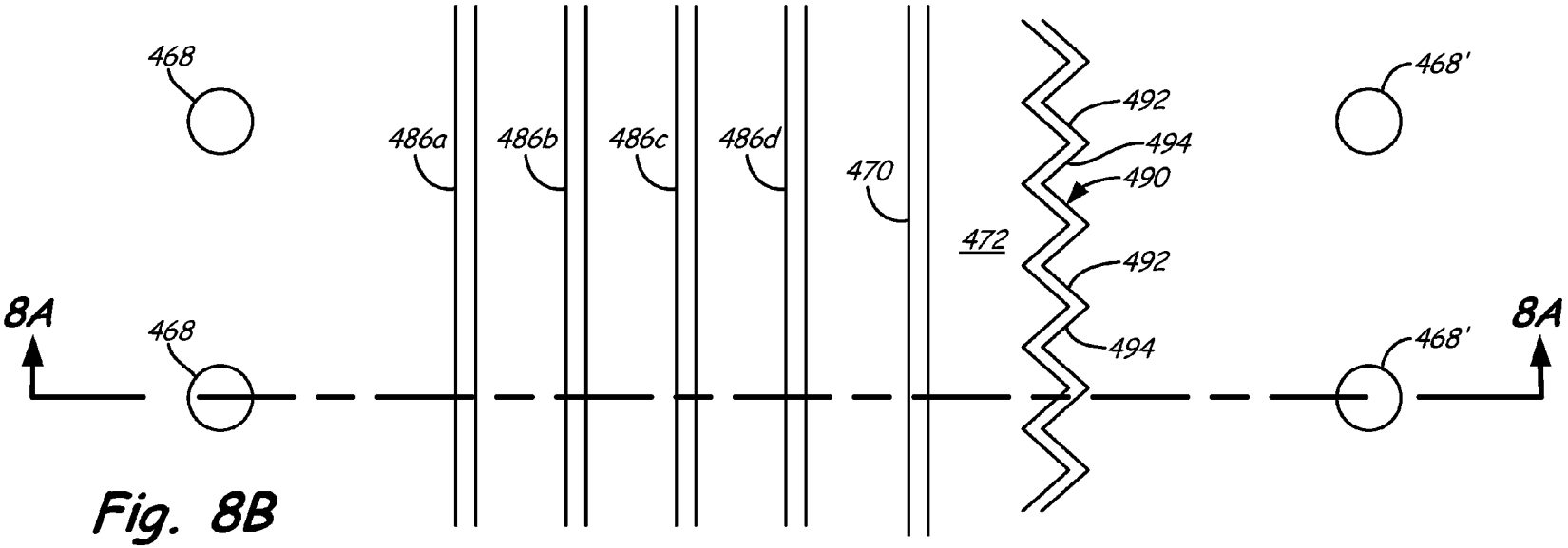

Another example illustrating the combination of features is shown in FIGS. 8A and 8B. FIGS. 8A and 8B are further enlarged side and top sectional views, respectively, of another embodiment of a combustor liner of the combustor of FIG. 2. The embodiment illustrated in FIGS. 8A and 8B adds convergent channel 482 to the embodiment describe above in reference to FIGS. 7A and 7B.

Combustor liner 430 is identical to combustor liner 330 described above, with numbering of like elements increased by 100, except that combustor liner 430 replaces pedestal array 380 with convergent channel 482. Convergent channel 482 is identical to convergent channel 182 as described above in reference to FIGS. 5A and 5B with numbering of like elements increased by 100.

In operation, the flow of cooling air Fc flows into cooling air passageway 478 through row of impingement holes 468. The flow of cooling air Fc impinges upon shield cold side 472, absorbing heat and cooling aft OD heat shield 450. The flow of cooling air Fc then flows through convergent channel 482. The decreasing gaps of convergent channel 482 in the downstream direction cause an increase in the velocity of the flow of cooling air Fc. In combination with the turbulent flow created by plurality of trip strips 484, the increase in velocity increases the convective heat transfer from aft OD heat shield 450 to the flow of cooling air Fc. As the flow of cooling air Fc exits convergent channel 482 and flows along shield cold side 472, it picks up heat from aft OD heat shield 450 and the velocity decreases. The flow of cooling air Fc then flows through the gap between jet wall 470 and shield cold side 472. The large reduction in the area available for the flow of cooling air Fc presented by jet wall 470 results in a large increase in the velocity of the flow of cooling air Fc issuing from jet wall 470 and along shield cold side 472 in the tangential or shear direction The resulting wall shear jet greatly increases the convective heat transfer between the flow of cooling air Fc and aft OD heat shield 450. As the flow of cooling air Fc flows along shield cold side 472 and picks up heat from aft OD heat shield 450, the velocity decreases. Once the velocity decreases such that heat transfer heat from aft OD heat shield 450 is nearly insufficient, the flow of cooling air Fc flows through multi-cornered film cooling slot 490 on to shield hot side 474 to produce a protective cooling film on shield hot side 474.

By employing convergent channel 482 in addition to jet wall 470, multi-cornered film cooling slot 490, and dilution openings 56, combustor liner 430 obtains the benefits of all features resulting in largest reduction in the cooling air required to cool combustor 16. As with the previous embodiments, the pattern of efficient use may be repeated along combustor liner 430.

For the sake of brevity, all embodiments above are illustrated with respect to an aft outer diameter portion of a combustion liner. However, it is understood that embodiments encompassed by the present invention include other portions of the combustion liner, such as the aft inner diameter, forward outer diameter, and forward inner diameter portions.

Embodiments of the present invention improve the efficiency of a gas turbine engine by reducing the cooling air required to cool a combustor. Combustor liners may include any or all of four features: dilution openings in a staggered, overlapping arrangement, a convergent channel within the combustor liner, a jet wall within the combustor liner, and a multi-cornered cooling film slot. Dilution openings in a staggered, overlapping arrangement provide full circumferential coverage around a combustor and eliminate high-heat flux areas downstream of the dilution openings. A convergent channel within the liner increases cooling flow velocity and improves convective heat transfer from the combustor liner. A jet wall within the liner also increases the velocity of cooling air by creating a wall shear jet across the surface within the combustor liner. Finally, a multi-cornered film cooling slot forms a film cooling layer that spreads out to uniformly cover the surface of the liner facing the combustion chamber. The uniform film cooling layer also decays more slowly, so multi-cornered film cooling slots may be spaced farther apart. Together, the staggered dilution openings, convergent channel, wall shear jet, and multi-cornered film cooling slot significantly reduce the cooling air requirements of a combustor and improve the fuel efficiency of a gas turbine engine.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

A heat shield for a combustor liner can include a plurality of first linear film cooling slots through the heat shield and a plurality of second linear film cooling slots through the heat shield; the plurality of first linear film cooling slots running in a row; each of the first linear film cooling slots angled from the row in a first direction; and the plurality of second linear film cooling slots running in the row; each second linear film cooling slot angled from the row in a second direction opposite the first direction; the second linear film cooling slots alternating with the first linear film cooling slots in the row; the first and second linear film cooling slots connected to form a single, multi-cornered film cooling slot.

The component of the preceding paragraph can optionally include, additionally and/or alternatively, any one or more of the following features, configurations and/or additional components:

wherein the plurality of first linear film cooling slots are angled at about 45 degrees in the first direction from the row; and the second linear film cooling slots are angled at about minus 45 degrees in the second direction from the row;

a plurality of rows of multi-cornered film cooling slots, the rows running parallel to each other;

the heat shield is arcuate in shape defining an axis and a circumferential direction; the row of the multi-cornered film cooling slot runs in the circumferential direction; and the first direction and the second direction are in a first axial direction and second axial direction, respectively;

a first row of dilution openings in the heat shield, the first row of dilution openings running in the circumferential direction; and a second row of dilution openings in the heat shield, the second row of dilution openings running parallel to the first row of dilution openings and axially spaced from the first row of dilution openings; each dilution opening of the second row of dilution openings at least partially overlapping in an axial direction a portion of each of two adjacent dilution openings of the first row of dilution openings; and the dilution openings are substantially rectangular.

A combustor liner for a gas turbine engine can include a shell and a heat shield attached to the shell; the shell including a shell cold side; and a shell hot side; and the heat shield including a shield cold side facing the shell hot side; a shield hot side facing away from the shell hot side; and a multi-cornered film cooling slot including a plurality of first linear film cooling slots through the heat shield and a plurality of second linear film cooling slots through the heat shield; the plurality of first linear film cooling slots running in a row; each of the first linear film cooling slots angled from the row in a first direction; the plurality of second linear film cooling slots running in the row; each second linear film cooling slot angled from the row in a second direction opposite the first direction; the second linear film cooling slots alternating with the first linear film cooling slots in the row; the first and second linear film cooling slots connected to form a single film cooling slot.

The component of the preceding paragraph can optionally include, additionally and/or alternatively, any one or more of the following features, configurations and/or additional components:

the plurality of first linear film cooling slots are angled at about 45 degrees in the first direction from the row; and the second linear film cooling slots are angled at about minus 45 degrees in the second direction from the row;

the heat shield further includes a plurality of rows of multi-cornered film cooling slots, the rows running parallel to each other;

the combustor liner is arcuate in shape defining an axis and a circumferential direction, wherein the row of the multi-cornered film cooling slot runs in the circumferential direction; and the first direction and the second direction are in a first axial direction and second axial direction, respectively;

a first row of dilution openings in the heat shield, the first row of dilution openings running in the circumferential direction; and a second row of dilution openings in the heat shield, the second row of dilution openings running parallel to the first row of dilution openings and axially spaced from the first row of dilution openings; each dilution opening of the second row of dilution openings at least partially overlapping in an axial direction a portion of each of two adjacent dilution openings of the first row of dilution openings;

the dilution openings are substantially rectangular;

a row of cooling holes through the shell; a series of trip strips projecting from the shield cold side, the trip strips running parallel to each other and all projecting from the shield cold side the same distance; and a series of projecting walls, each projecting wall running parallel to, and opposite of, a corresponding trip strip and projecting from the shell hot side such that a distance to which each projecting wall projects from the shell hot side is greater for projecting walls farther from the row of cooling holes to create successive gaps between projecting walls and corresponding trip strips that decrease from the row of cooling holes to create a convergent channel; and a plurality of series of trip strips and a plurality of projecting walls creating a plurality of convergent channels; the shell further including a plurality of rows of cooling holes; and the heat shield further including a plurality of rows of multi-cornered film cooling slots, the rows of multi-cornered film cooling slots running parallel to each other; the rows of cooling holes, the convergent channels, and the multi-cornered film cooling slots alternating across the combustor liner.

A method of cooling a combustor liner of a gas turbine engine can include providing cooling air to the combustor liner; flowing the cooling air to an interior of the combustor liner through a row of cooling holes in the combustor liner; flowing the cooling air from the row of cooling holes to a multi-cornered film cooling slot leading from the interior of the combustor liner to an exterior of the combustor liner; passing the cooling air through the multi-cornered film cooling slot; flowing the cooling air out of the multi-cornered film cooling slot; and forming a cooling film on the exterior of the combustor liner.

The method of the preceding paragraph can optionally include, additionally and/or alternatively, any one or more of the following features, configurations and/or additional components:

flowing the cooling air through dilution openings in the combustor liner to create a first row of dilution jets at an exterior of the combustor liner; flowing the cooling air through dilution openings in the combustor liner to create a second row of dilution jets at the exterior of the combustor liner in a staggered, overlapping relationship with first row of dilution jets; producing staggered, overlapping dilution jets at the exterior of the combustor liner; and creating an even dilution air flow pressure distribution from the staggered, overlapping dilution air jets to promote cooling by eliminating hot spots on a portion of the exterior of the combustor liner; and increasing the velocity of the cooling air within the combustor liner by flowing it through a converging channel formed by a series of decreasing gaps between projecting walls and trip strips; cooling a portion of the surface within the combustor liner with the increased velocity cooling air from the converging channel; and flowing the cooling air from the converging channel to the multi-cornered film cooling slot.

The invention claimed is:

1. A heat shield for a combustor liner, the heat shield comprising:

a plurality of first linear film cooling slots through the heat shield, the plurality of first linear film cooling slots running in a row; each of the first linear film cooling slots angled from the row in a first direction; and a plurality of second linear film cooling slots through the heat shield, the plurality of second linear film cooling slots running in the row; each second linear film cooling slot angled from the row in a second direction opposite the first direction; the second linear film cooling slots alternating with the first linear film cooling slots in the row; the first and second linear film cooling slots connected to form a single, multi-cornered film cooling slot.

2. The heat shield of claim 1, wherein the plurality of first linear film cooling slots are angled at about 45 degrees in the first direction from the row; and the second linear film cooling slots are angled at about minus 45 degrees in the second direction from the row.

3. The heat shield of claim 1, further comprising:

a plurality of rows of multi-cornered film cooling slots, the rows running parallel to each other.

4. The heat shield of claim 1, wherein the heat shield is arcuate in shape defining an axis and a circumferential direction; the row of the multi-cornered film cooling slot runs in the circumferential direction; and the first direction and the second direction are in a first axial direction and second axial direction, respectively.

5. The heat shield of claim 4, further comprising:

a first row of dilution openings in the heat shield, the first row of dilution openings running in the circumferential direction; and a second row of dilution openings in the heat shield, the second row of dilution openings running parallel to the first row of dilution openings and axially spaced from the first row of dilution openings; each dilution opening of the second row of dilution openings at least partially overlapping in an axial direction a portion of each of two adjacent dilution openings of the first row of dilution openings.

6. The heat shield of claim 5, wherein the dilution openings are substantially rectangular.

7. A combustor liner for a gas turbine engine, the combustor liner comprising:

a shell including:

a shell cold side; and a shell hot side; and a heat shield attached to the shell, the heat shield including:

a shield cold side facing the shell hot side;

a shield hot side facing away from the shell hot side; and a multi-cornered film cooling slot including:

a plurality of first linear film cooling slots through the heat shield, the plurality of first linear film cooling slots running in a row; each of the first linear film cooling slots angled from the row in a first direction; and a plurality of second linear film cooling slots through the heat shield, the plurality of second linear film cooling slots running in the row; each second linear film cooling slot angled from the row in a second direction opposite the first direction; the second linear film cooling slots alternating with the first linear film cooling slots in the row; the first and second linear film cooling slots connected to form a single film cooling slot.

8. The combustor liner of claim 7, wherein the plurality of first linear film cooling slots are angled at about 45 degrees in the first direction from the row; and the second linear film cooling slots are angled at about minus 45 degrees in the second direction from the row.

9. The combustor liner of claim 7, wherein the heat shield further includes:

a plurality of rows of multi-cornered film cooling slots, the rows running parallel to each other.

10. The combustor liner of claim 7, wherein the combustor liner is arcuate in shape defining an axis and a circumferential direction, wherein the row of the multi-cornered film cooling slot runs in the circumferential direction; and the first direction and the second direction are in a first axial direction and second axial direction, respectively.

11. The combustor liner of claim 10, further comprising:

a first row of dilution openings in the heat shield, the first row of dilution openings running in the circumferential direction; and a second row of dilution openings in the heat shield, the second row of dilution openings running parallel to the first row of dilution openings and axially spaced from the first row of dilution openings; each dilution opening of the second row of dilution openings at least partially overlapping in an axial direction a portion of each of two adjacent dilution openings of the first row of dilution openings.

12. The combustor liner of claim 11, wherein the dilution openings are substantially rectangular.

13. The combustor liner of claim 11, further comprising:

a row of cooling holes through the shell;

a series of trip strips projecting from the shield cold side, the trip strips running parallel to each other and all projecting from the shield cold side the same distance; and a series of projecting walls, each projecting wall running parallel to, and opposite of, a corresponding trip strip and projecting from the shell hot side such that a distance to which each projecting wall projects from the shell hot side is greater for projecting walls farther from the row of cooling holes to create successive gaps between projecting walls and corresponding trip strips that decrease from the row of cooling holes to create a convergent channel.

14. The combustor liner of claim 13, further comprising:

a plurality of series of trip strips and a plurality of projecting walls creating a plurality of convergent channels;

the shell further including a plurality of rows of cooling holes; and the heat shield further including a plurality of rows of multi-cornered film cooling slots, the rows of multi-cornered film cooling slots running parallel to each other; the rows of cooling holes, the convergent channels, and the multi-cornered film cooling slots alternating across the combustor liner.

15. A method of cooling a combustor liner of a gas turbine engine comprises:

providing cooling air to the combustor liner;

flowing the cooling air to an interior of the combustor liner through a row of cooling holes in the combustor liner;

flowing the cooling air from the row of cooling holes to a multi-cornered film cooling slot leading from the interior of the combustor liner to an exterior of the combustor liner;

passing the cooling air through the multi-cornered film cooling slot;

flowing the cooling air out of the multi-cornered film cooling slot;

forming a cooling film on the exterior of the combustor liner;

flowing the cooling air through dilution openings in the combustor liner to create a first row of dilution jets at an exterior of the combustor liner;

flowing the cooling air through dilution openings in the combustor liner to create a second row of dilution jets at the exterior of the combustor liner in a staggered, overlapping relationship with the first row of dilution jets;

producing staggered, overlapping dilution jets at the exterior of the combustor liner; and creating an even dilution air flow pressure distribution from the staggered, overlapping dilution air jets to promote cooling by eliminating hot spots on a portion of the exterior of the combustor liner.

16. The method of claim 15, wherein flowing the cooling air from the row of cooling holes to a multi-cornered film cooling slot includes:

increasing the velocity of the cooling air within the combustor liner by flowing it through a converging channel formed by a series of decreasing gaps between projecting walls and trip strips;

cooling a portion of the surface within the combustor liner with the increased velocity cooling air from the converging channel; and flowing the cooling air from the converging channel to the multi-cornered film cooling slot.

* * * * *